US007071891B2

(12) United States Patent
Shirosaka et al.

(10) Patent No.: US 7,071,891 B2
(45) Date of Patent: Jul. 4, 2006

(54) ANTENNA APPARATUS

(75) Inventors: Toshiaki Shirosaka, Kobe (JP); Kiyotaka Tatekawa, Kobe (JP); Toshio Fujita, Kobe (JP)

(73) Assignee: DX Antenna Company, Limited, Kobe (JP)

( * ) Notice: Subject to any disclaimer, the term of this patent is extended or adjusted under 35 U.S.C. 154(b) by 0 days.

(21) Appl. No.: 11/076,703

(22) Filed: Mar. 10, 2005

(65) Prior Publication Data

US 2006/0044203 A1 Mar. 2, 2006

(30) Foreign Application Priority Data

Sep. 1, 2004 (JP) ..... 2004-254165

(51) Int. Cl.
*H01Q 21/00* (2006.01)
*H01Q 21/12* (2006.01)
*H01Q 1/42* (2006.01)

(52) U.S. Cl. ..... 343/810; 343/814; 343/872

(58) Field of Classification Search ..... 343/793, 343/795, 810, 812, 813, 814, 853, 872
See application file for complete search history.

(56) References Cited

U.S. PATENT DOCUMENTS

| | | | | |
|---|---|---|---|---|
| 2,702,347 | A * | 2/1955 | Spindler | 343/702 |
| 4,122,447 | A * | 10/1978 | Kawai et al. | 343/814 |
| 6,201,510 | B1 * | 3/2001 | Lopez et al. | 343/799 |
| 6,498,589 | B1 | 12/2002 | Horii | |
| 6,774,863 | B1 * | 8/2004 | Shirosaka et al. | 343/797 |
| 6,933,907 | B1 * | 8/2005 | Shirosaka et al. | 343/810 |
| 2004/0252070 | A1 * | 12/2004 | Bisiules et al. | 343/797 |

* cited by examiner

*Primary Examiner*—Shih-Chao Chen
(74) *Attorney, Agent, or Firm*—Duane Morris LLP

(57) ABSTRACT

First, second, third and fourth dipole antennas (14, 16, 18, 20) are disposed in a casing (1). The first through fourth dipole antennas are arranged in the same plane, and are disposed in line symmetry with respect to first through fourth imaginary lines (A, B, C, D) passing through the center of the casing (1) at an angle of 45 degrees between adjacent imaginary lines.

5 Claims, 8 Drawing Sheets

ANTENNA APPARATUS

This invention relates to an antenna apparatus and, more particularly, to an antenna apparatus housed in a casing.

BACKGROUND OF THE INVENTION

An example of an antenna apparatus housed in a casing is disclosed in U.S. Pat. No. 6,498,589 patented on Dec. 24, 2002. The antenna apparatus disclosed therein includes a main body having a generally octagonal shape in plan, and a lid or cover closing an opening in the main body. Four Yagi antennas are arranged in the main body. First two of the four Yagi antennas are aligned on a first imaginary straight line passing through the main body, and exhibit directivities oriented in mutually opposite directions along the first imaginary straight line. The remaining, second two Yagi antennas are aligned on a second imaginary straight line extending orthogonal to the first imaginary straight line and exhibit directivities oriented in mutually opposite directions along the second imaginary straight line. The second two Yagi antennas are disposed in a plane at a level vertically deviated from the level of the plane in which the first two Yagi antennas are disposed. Each Yagi antenna includes antenna elements, namely, a radiator, a reflector and a director, and is disposed within the main body.

The prior art antenna apparatus includes four Yagi antennas so as to have directivities oriented in different four directions, and each Yagi antenna includes a plurality of elements, such as a radiator, a reflector and a director. Four of such Yagi antennas formed of many components must be housed in a single casing, and, therefore, the assembling efficiency is low. In addition, two Yagi antennas must be placed in one plane, while remaining two must be placed in a different plane, which further degrades the assembling efficiency.

An object of the present invention is to provide an antenna apparatus which can be assembled with improved efficiency.

SUMMARY OF THE INVENTION

An antenna apparatus according to an embodiment of the present invention includes a casing, and first through fourth dipole antennas arranged in the casing. From the point of view of downsizing the antenna apparatus, it is preferred that the casing should be flat. The first through fourth dipole antennas are for receiving radio waves in the same frequency band. Folded-dipole antennas as well as ordinary dipole antennas may be used.

The first and second dipole antennas are disposed on opposite sides of a first imaginary line passing through the casing. The distance between the first and second dipole antennas should preferably be not greater than a quarter (¼) of the wavelength of the center frequency of the frequency band to be received by the first and second dipole antennas. Feed points of the first and second dipole antennas are at locations on opposite sides of an intersection of the first imaginary line and a second imaginary straight line extending orthogonal to the first imaginary line.

The third and fourth dipole antennas are disposed on opposite sides of the second imaginary line, and their feed points are on opposite sides of the intersection of the first and second imaginary lines. The distance between the third and fourth dipole antennas should preferably be not greater than a quarter (¼) of the wavelength of the center frequency of the frequency band to be received by the third and fourth dipole antennas.

The first and second dipole antennas are in line symmetry, with the second imaginary line being the axis of symmetry, and the third and fourth dipole antennas are in line symmetry, with the first imaginary line being the axis of symmetry. The first through fourth dipole antennas are in line symmetry with third and fourth imaginary straight lines which pass through the intersection of the first and second imaginary lines at 45 degrees with respect to the first and second imaginary lines, respectively. The first through fourth dipole antennas are in the same plane, and each may be formed of lines formed on a single dielectric board or formed of lines formed on two different dielectric boards.

A directivity adjusting means is disposed in the casing. The directivity adjusting means adjusts the phases and levels of reception signals from the first through fourth dipole antennas. (In this specification, a reception signal means a signal resulting from receiving a radio wave by an antenna.) The directivity adjusting means makes it possible to change combined directivities of the first through fourth dipole antennas as desired.

The directivity adjusting means may include first and second phase adjusting means level adjusting and combining means.

The first phase adjusting means adjusts the phases of reception signals from the first and second dipole antennas and combines them into a combined signal. In this case, the reception signal from one of the first and second dipole antennas may be adjusted to have the same phase as the reception signal from the other of the first and second dipole antennas, or the reception signals from both dipole antennas may be adjusted to have the same phase. The phase adjustment and combining makes it possible to orient the combined directivity of the first and second dipole antennas to a selected one of a first direction along the second imaginary line and a second direction opposite to the first direction. The second phase adjusting means adjusts the phases of reception signals from the third and fourth dipole antennas and combines them into a combined signal. In this case, the reception signal from one of the third and fourth dipole antennas may be adjusted to have the same phase as the reception signal from the other of the third and fourth dipole antennas, or the reception signals from both dipole antennas may be adjusted to have the same phase. The phase adjustment and combining makes it possible to orient the combined directivity of the third and fourth dipole antennas to a selected one of a third direction along the first imaginary line and a fourth direction opposite to the third direction.

The level adjusting and combining means adjusts the levels of output signals of the first and second phase adjusting means and combines them, which makes it possible to change the combined directivities of the first through fourth dipole antennas as desired. The first and second phase adjusting means and the level adjusting and combining means are disposed within the casing.

Since the first through fourth antennas are dipole antennas of relatively simple structure and are arranged in the same plane, they can be assembled in the casing with high efficiency. In addition, since the first through fourth dipole antennas are arranged in line symmetry with respect to the first through fourth imaginary lines, combined directivities of the first through fourth antennas can be in symmetry, with the respective imaginary lines being axes of symmetry. Baluns may be used for coupling the reception signals from the first through fourth dipole antennas to the first and second phase adjusting means. Each balun should preferably be at a location on the imaginary line between the two feed points of associated dipole antennas so that it is in line symmetry with respect to that imaginary line. Also, the baluns for the first and second dipole antennas are disposed in line symmetry with respect to the first imaginary line, and the baluns for the third and fourth dipole antenna are disposed in line symmetry with respect to the second imaginary line. This arrangement of the baluns enables the use of connecting lines of the substantially same length for connecting the feed points of the respective dipole antennas, which are in line symmetry with respect to the first through fourth imaginary lines, to the associated baluns, so that the phases of the reception signals supplied to the baluns can match with each other.

Each of the first through fourth dipole antennas may be formed of two antenna elements, whose innermost end portions are located outward of the intersection of the imaginary lines.

The innermost end portions of the antenna elements of the first dipole antenna may be disposed to intersect those innermost end portions of the antenna elements of the third and fourth dipole antennas which are on the same side of the first imaginary line as the first dipole antenna is disposed. The innermost end portions of the antenna elements of the second dipole antenna are arranged to intersect those innermost end portions of the antenna elements of the third and fourth dipole antennas which are on the same side of the first imaginary line as the second dipole antenna is disposed. The intersections of the innermost end portions of the antenna elements are on the third and fourth imaginary lines.

With this arrangement in which the innermost end portions of the antenna elements of the first through fourth dipole antennas intersect, the four dipole antennas can be disposed within a small casing, which downsizes the antenna apparatus as a whole.

A rectangular substrate on which first and second phase adjusting means and the level adjusting and combining means are mounted may be disposed in such a manner that the center of said substrate can be located in the vicinity of the intersection of the imaginary lines. The substrate has its diagonals extending along the first and second imaginary lines, and has its corners cut away. With this arrangement, the antenna apparatus can be further reduced in size.

DESCRIPTION OF PREFERRED EMBODIMENT OF THE INVENTION

Figure 3:
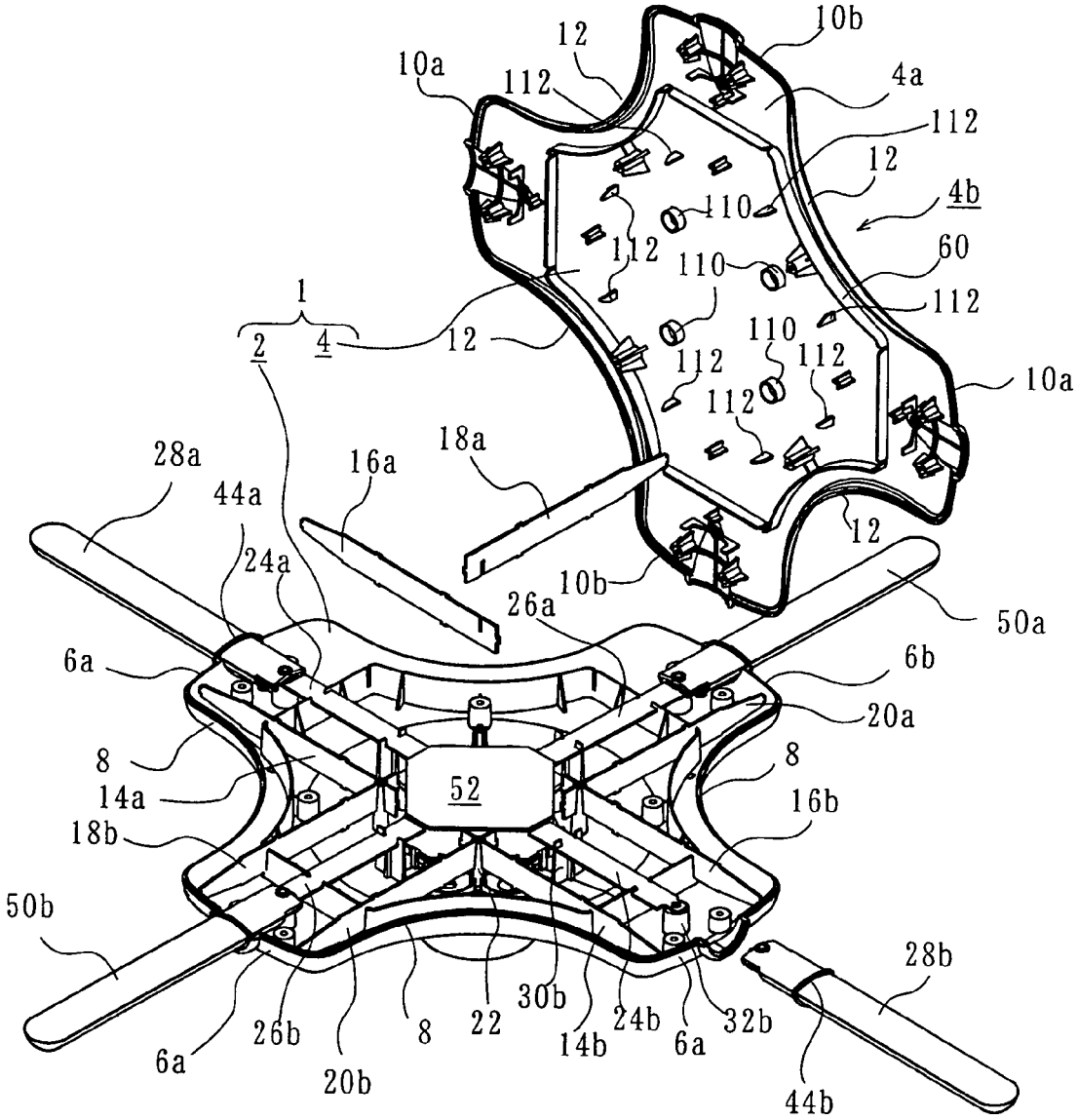
FIG. 3 is an exploded view of the antenna apparatus shown in FIG. 1.

Referring to FIG. 3, an antenna apparatus according to the present invention includes a casing 1. The casing 1 is formed of a main body 2 and a lid 4. The main body 2 is formed of, for example, a synthetic resin, and has a generally octagonal shape in plan. The inner bottom surface of the casing 1 slopes downward from the peripheral portion toward the center, and is open at one side, e.g. upper side. The opening is closed by the lid 4, which is also octagonal in plan. The lid 4, too, is formed of a synthetic resin, for example, and slopes upward from its peripheral portion toward the center.

Figure 1:
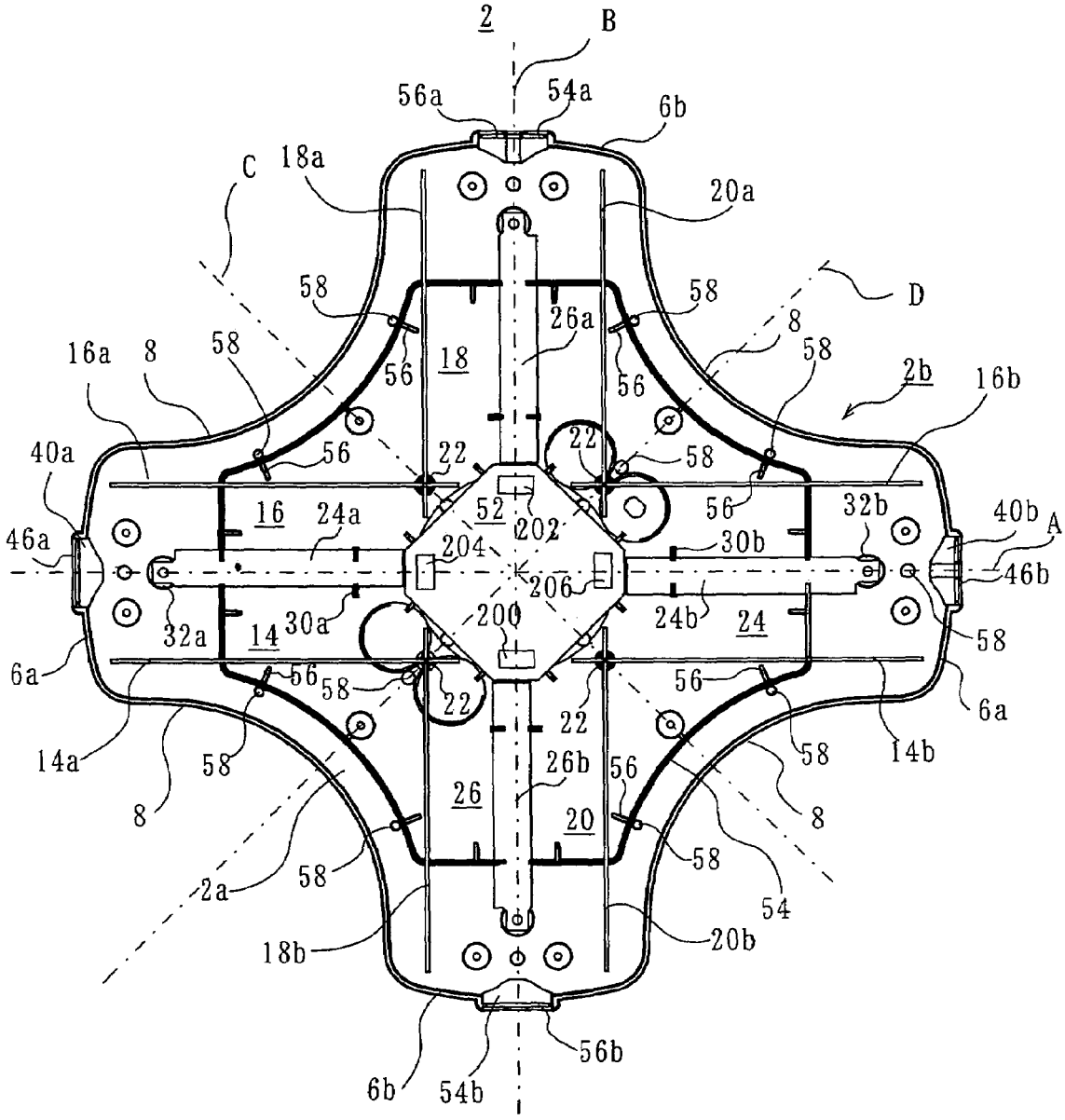
FIG. 1 is a plan view of an antenna apparatus according to an embodiment of the present invention, with a lid of a casing and some antenna components removed.
Figure 2:
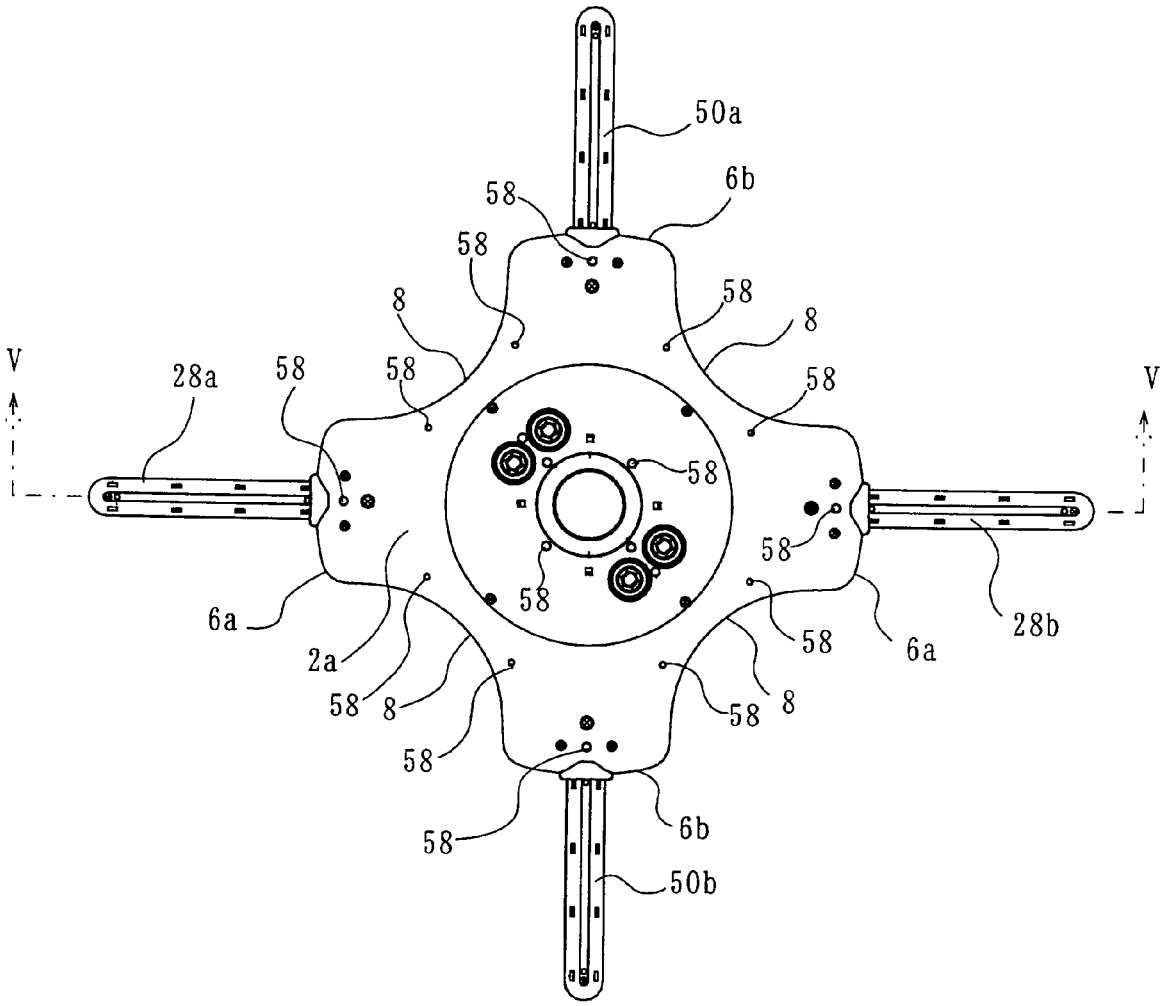
FIG. 2 is a bottom plan view of the antenna apparatus shown in FIG. 1.
Figure 4:
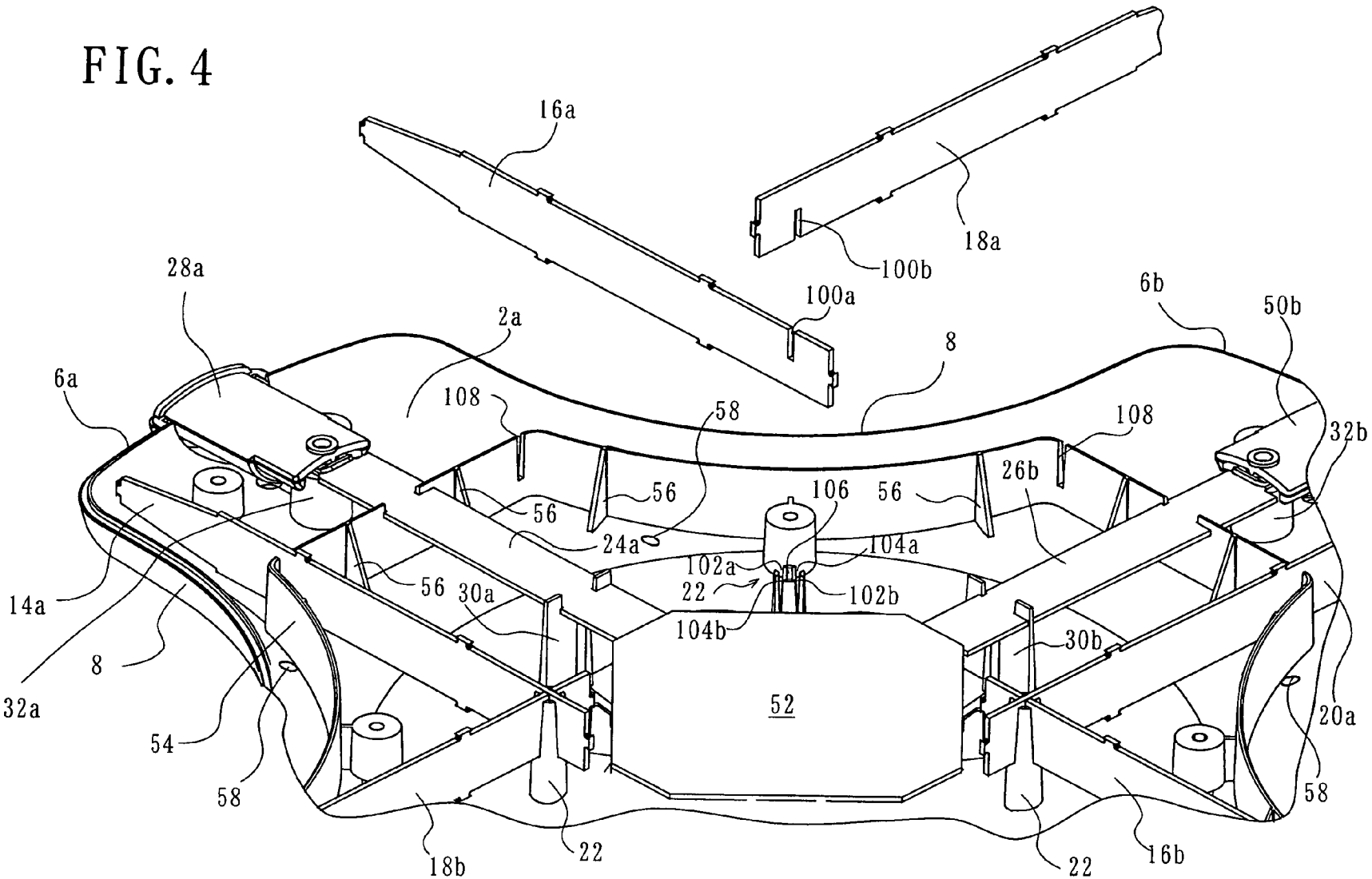
FIG. 4 is an enlarged perspective view of part of the antenna apparatus shown in FIG. 1.

The main body 2 has a bottom wall 2*a* and a peripheral wall 2*b* extending along the periphery of the bottom wall 2*a*, as shown in FIG. 1. As shown in FIGS. 2, 3 and 4, the peripheral wall 2*b* includes a pair of spaced-apart ends 6*a*, 6*a*, and also a pair of spaced-apart ends 6*b*, 6*b*. The line connecting the ends 6*a* and 6*a* orthogonally intersects the line connecting the ends 6*b* and 6*b*. Arcuate edge members 8 connect adjacent ones of the ends 6*a* and 6*b*. The ends 6*a* and 6*b* and the arcuate edge members 8 rise substantially perpendicularly upward from the bottom wall 2*a* toward the opening and are formed integral with the periphery of the bottom wall 2*a*.

The lid 4, too, is formed of a top wall 4*a* and a peripheral wall 4*b*, as shown in FIG. 3. The peripheral wall 4*b* has a pair of spaced-apart ends 10*a*, 10*a* and a pair of spaced-apart ends 10*b*, 10*b*. The line connecting the ends 10*a*, 10*a* orthogonally intersects the line connecting the ends 10*b*, 10*b*. The peripheral wall 4*b* also includes four arcuate edge members 12 connecting adjacent ones of the ends 10*a* and 10*b*. The ends 10*a* and 10*b* and the arcuate edge members 12 rise substantially perpendicularly from the top wall 4*a* and are formed integral with the peripheral edge of the top wall 4*a*.

As shown in FIG. 1, let four imaginary lines A, B, C and D passing through the center of the main body 2 be imagined. The imaginary line A passes through the center of the main body 2 and connects the ends 6*a* and 6*a*, and the imaginary line B orthogonally intersects the imaginary line A at the center of the main body 2 and connects the ends 6*b* and 6*b*. The imaginary line C intersects the imaginary lines A and B at the center of the main body 2 at an angle of 45 degrees. The imaginary line D intersects the imaginary lines A, B and C at the center of the main body 2 at an angle of 45 degrees with respect to the virtual lines A and B and at right angles with respect to the imaginary line C.

A dipole antenna 14 is disposed within the main body 2, being spaced by a predetermined distance from and in parallel with the imaginary line A. The dipole antenna 14 is formed of first and second antenna elements 14*a* and 14*b* disposed on the same straight line with a spacing disposed between their innermost ends. A dipole antenna 16 is disposed in line symmetry with the dipole antenna 14 with the imaginary line A being the axis of symmetry. The dipole antenna 16, too, is formed of third and fourth antenna elements 16*a* and 16*b* having their innermost ends spaced by a predetermined distance along the same line. The first antenna element 14*a* and the third antenna element 16*a* face each other across the imaginary line A, and the second antenna element 14*b* and the fourth antenna element 16*b* face each other across the imaginary line A.

Similarly, a dipole antenna 18 is disposed within the main body 2, being spaced by a predetermined distance from and in parallel with the imaginary line B. The dipole antenna 18 is formed of fifth and sixth antenna elements 18*a* and 18*b* disposed on the same straight line with a spacing disposed between their innermost ends. A dipole antenna 20 is disposed in line symmetry with the dipole antenna 18 with the imaginary line B being the axis of symmetry. The dipole antenna 20 is formed of seventh and eighth antenna elements

20*a* and 20*b* having their innermost ends spaced by a predetermined distance along the same line. The fifth antenna element 18*a* and the seventh antenna element 20*a* face each other across the imaginary line B, and the sixth antenna element 18*b* and the eighth antenna element 20*b* face each other across the imaginary line B.

With the imaginary line C as the axis of symmetry, the antenna elements 16*a* and 18*a* are in line symmetry, the antenna elements 14*a* and 20*a* are in line symmetry, the antenna elements 18*b* and 16*b* are in line symmetry, and the antenna elements 20*b* and 14*b* are in line symmetry. Similarly, with the imaginary line D being the axis of symmetry, the antenna elements 20*a* and 16*b*, the antenna elements 18*a* and 14*b*, the antenna elements 16*a* and 20*b*, and the antenna elements 14*a* and 18*b* are respectively in line symmetry.

Each of the antenna elements 14*a*, 14*b*, 16*a*, 16*b*, 18*a*, 18*b*, 20*a* and 20*b* includes two line members formed on a rectangular printed circuit board by etching. Each of the two line members of each antenna element includes a line having a length selected for reception of a first frequency band, e.g. the UHF television broadcast signal band, and an extension which is adapted to be connected in series with the line through an electronic switch, such as a PIN diode. The length of the extension is so determined that signals in a VHF high television broadcast frequency band can be received by means of the line and the extension interconnected via the electronic switch. The antenna elements 14*a*, 14*b*, 16*a*, 16*b*, 18*a*, 18*b*, 20*a* and 20*b* are disposed such that the surfaces of the printed circuit boards are substantially perpendicular to the opening of the main body 2.

The distance between the dipole antennas 14 and 16 is shorter than a quarter (¼) of the wavelength λ at the center frequency of the UHF television broadcast signal band, which may be, for example, one-eighth (⅛) of the wavelength λ. The distance between the dipole antennas 18 and 20 is similarly determined, e.g. one-eighth (⅛) of the wavelength λ.

The dipole antennas 14 and 16 exhibit an 8-shaped directivity pattern along the line connecting the ends 6*b* and 6*b*, i.e. along the imaginary line B. The dipole antennas 18 and 20 exhibit an 8-shaped directivity pattern along the line connecting the ends 6*a* and 6*a*, i.e. along the imaginary line A. In other words, the directivity patterns of the dipole antennas 14 and 16 are oriented in a direction different by, for example, 90 degrees, from the directivity patterns of the dipole antennas 18 and 20.

The innermost portions of the antenna elements 14*a* and 18*b*, the innermost portions of the antenna elements 14*b* and 20*b*, the innermost portions of the antenna elements 16*a* and 18*a*, and the innermost portions of the antenna elements 16*b* and 20*a* intersect each other at associated ones of first supports, e.g. bosses 22. Four such bosses 22 are formed integral with the bottom wall 2*a* to extend upward, and support the antenna elements 14*a*, 14*b*, 16*a*, 16*b*, 18*a*, 18*b*, 20*a* and 20*b*.

The antenna elements 16*a* and 18*a* are described as an example. As is seen in FIG. 4, the innermost portion of the antenna element 16*a* is provided with a slit 100*a* extending in the width direction from its upper edge to a point intermediate between the upper and lower edges thereof. On the other hand, the innermost portion of the antenna element 18*a* is provided with a slit 100*b* extending in the width direction from its lower edge to a point intermediate between the upper and lower edges thereof. The slits 100*a* and 100*b* engage with each other. The depth or length of the slit 100*b* is equal to the distance of the bottom of the slit 100*a* from the lower edge of the antenna element 16*a*, so that, when the antenna elements 16*a* and 18*a* are placed to intersect each other with the slits 100*a* and 100*b* engaging with each other, the upper edges of the antenna elements 16*a* and 18*a* can be aligned with each other. The other sets of the antenna elements, namely, the antenna elements 14*a* and 18*b*, the antenna elements 14*b* and 20*b*, and the antenna elements 16*b* and 20*a*, are provided with similarly engaging slits and arranged to intersect each other. It should be noted that the intersecting antenna elements of each set are electrically insulated from each other.

As shown in FIG. 4, each boss 22 has a rim including two vertical slits 102*a* and 102*b* located along a line parallel to the imaginary line A and two vertical slits 104*a* and 104*b* located along a line parallel to the imaginary line B. The vertical slits 102*a*, 102*b*, 104*a* and 104*b* extend downward from the top to a depth slightly shorter than the width of the major surfaces of the antenna elements. An opening 106 is formed to extend from the top to a depth at the bottom of the slits 102*a*, 102*b*, 104*a* and 104*b*, so that the slits 102*a*, 102*b*, 104*a* and 104*b* can be connected together by the opening 106. The intersection of the antenna elements 16*a* and 18*a*, for example, is inserted into this opening 106 in such a manner that the antenna element 16*a* extend through the slits 102*a* and 102*b*, while the antenna element 18*a* extend through the slits 104*a* and 104*b*. The intersections of the other antenna element sets 14*a* and 18*b*, 14*b* and 20*b*, and 16*b* and 20*a* are similarly placed in the openings 106 of the associated bosses 22. With the intersections of the antenna elements 14*a*, 14*b*, 16*a*, 16*b*, 18*a*, 18*b*, 20*a* and 20*b* positioned in this manner with respect to the respective bosses 22, the upper edges of the respective antenna elements are at a level slightly above the level of the tops of the bosses 22.

As shown in FIG. 1, a directive antenna, such as a dipole antenna, 24 is disposed between and in parallel with the dipole antennas 14 and 16. Similarly, a directive antenna, e.g. a dipole antenna 26 is disposed between and in parallel with the dipole antennas 18 and 20. The dipole antennas 24 and 26 are adapted to receive signals in a second frequency band, e.g. a VHF low television broadcast frequency band. The antenna 24 exhibits an 8-shaped directivity pattern oriented in the direction along the imaginary line B, whereas the antenna 26 exhibits an 8-shaped directivity pattern oriented in the direction along the imaginary line A. In other words, the dipole antennas 24 and 26 exhibit directivities oriented to directions different from each other by, for example, 90 degrees.

The dipole antenna 24 includes first elements 24*a* and 24*b*. The dipole antenna 24 includes also second elements 24*c* and 24*d* disposed within respective element cases 28*a* and 28*b* as shown in FIG. 5.

The first elements 24*a* and 24*b* each include lines formed on a printed circuit board by etching. The printed circuit boards are disposed in such a manner that their surfaces are substantially in parallel with the opening of the main body 2. The first elements 24*a* and 24*b* are supported at locations in their innermost end portions by respective supports 30*a* and 30*b*, which are formed integral with the bottom wall 2*a* and extend upward. Also, the first elements 24*a* and 24*b* are supported at their respective outer ends by respective bosses 32*a* and 32*b*, which are formed integral with the bottom wall 2*a* and extend upward.

Figure 5:
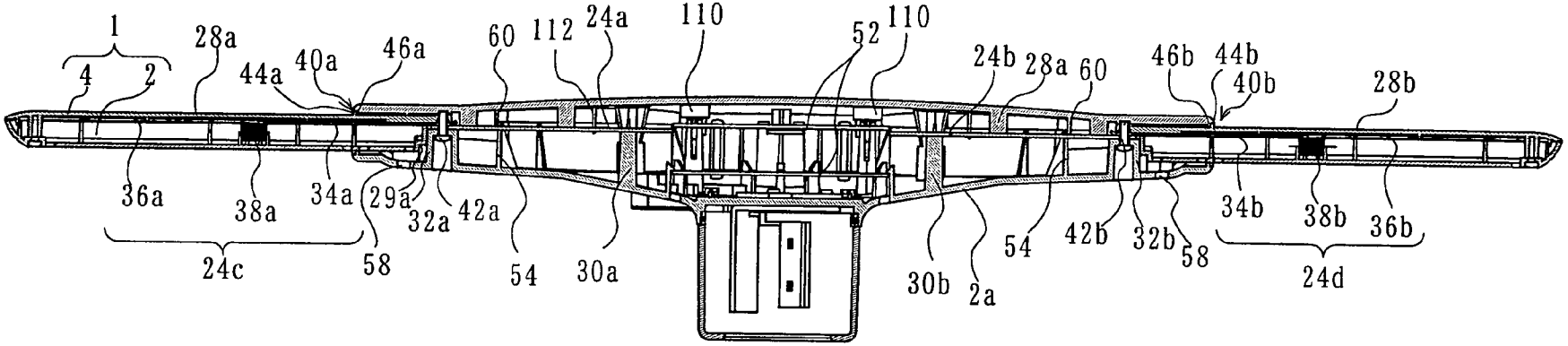
FIG. 5 is a cross-sectional view along a line V—V in FIG. 2.

As shown in FIG. 5, the second elements 24*c* and 24*d* each are formed on two printed circuit boards by etching. Specifically, the second element 24*c* includes two printed circuit boards 34*a* and 36*a* on which lines are formed by etching. The lines are connected together by a loading coil 38*a*. The printed circuit boards of the second element 24*c* are placed in the element case 28*a* and extend along the length of the case 28*a*, with their surfaces placed coplanar and in parallel with the surfaces of the first elements 24*a* and 24*b*. Similarly, the second element 24*d* includes two printed circuit boards 34*b* and 36*b*, on which lines are formed by etching. The lines are connected together by another loading coil 38*b*. The printed circuit boards of the second element 24*d* are placed in the element case 28*b* and extend along the length of the case 28*b*, with their surfaces placed coplanar and in parallel with the surfaces of the first elements 24*a* and 24*b*.

As shown in FIGS. 1 and 3, the proximal ends of the element cases 28*a* and 28*b* enter into the main body 2 respectively through holes 40*a* and 40*b*, formed by hole halves formed in the ends 6*a*, 6*a* of the main body 2 and in opposing ends 10*a*, 10*a* of the lid 4. The printed circuit boards of the second element 24*c* electrically contact the first element 24*a* on the boss 32*a*, and the printed circuit boards of the second element 24*d* electrically contact the first element 24*b* on the boss 32*b*. Securing means, e.g. screws, are inserted through the bosses 32*a* and 32*b* from under to mechanically couple the second elements 24*c* and 24*d* to the first elements 24*a* and 24*b*, respectively.

Annular first ridges 44*a* and 44*b* are formed around and integral with the proximal ends of the element cases 28*a* and 28*b*, respectively. As is understood from FIG. 1, second ridges 46*a* and 46*b* protruding inward are formed around the inner peripheries of the holes 40*a* and 40*b*. Only halves of the inner peripheral ridges 46*a* and 46*b* on the main body 2 are shown in FIG. 1. With the element cases 28*a* and 28*b* pushed into the casing 1 through the holes 40*a* and 40*b*, the first ridges 44*a* and 44*b* and the second ridges 46*a* and 46*b* are in surface contact so that rain or other foreign materials can be prevented from entering inside the casing 1.

Similar to the dipole antenna 24, the dipole antenna 26 includes first elements 26*a* and 26*b* disposed within the main body 2 and second elements (not shown) disposed within element cases 50*a* and 50*b*. The first elements 26*a* and 26*b*, the element cases 50*a* and 50*b*, and the second elements (not shown) are constructed and supported in the same manner as the first elements 24*a* and 24*b*, the second elements 24*c*, 24*d* and the element cases 28*a* and 28*b* of the dipole antenna 24, and, therefore, their detailed description is not given.

A directivity adjusting unit 52 is disposed in the vicinity of the innermost ends of the first elements 24*a*, 24*b*, 26*a* and 26*b* in the center portion of the main body 2. The directivity adjusting unit 52 includes circuitry for adjusting the phases of reception signals from the UHF band dipole antennas 14, 16, 18 and 20. The directivity adjusting unit 52 includes also electronic circuitry for adjusting the levels of the phase-adjusted reception signals from the UHF band dipole antennas 14, 16, 18 and 20 or reception signals from the VHF band dipole antennas 24 and 26, to thereby orient the combined directivity of the UHF band dipole antennas 14, 16, 18 and 20 or the combined directivity of the VHF band dipole antennas 24 and 26, to a desired direction. The combined directivities can be oriented to any desired direction by the use of the directivity adjusting unit 52. The details of these circuits will be described later.

The directivity adjusting unit 52 is formed on a printed circuit board arrangement formed of two printed circuit boards, which are disposed one above the other, as shown in FIG. 5. The two printed circuit boards are similarly formed in a generally rectangular shape, and have their diagonals lying on the imaginary lines A and B, as shown in FIG. 1. The corners of the two boards are cut away so that the innermost ends of the antenna elements 24*a*, 24*b*, 26*a* and 26*b* can be located nearer to the intersection of the imaginary lines A and B, than if the corners of the boards were not cut away.

For directivity adjustment, the reception signals from the dipole antennas 14, 16, 18 and 20, and the reception signals from the dipole antennas 24 and 26 are coupled to the directivity adjusting unit 52. Although not shown, transmission lines are provided for the signal coupling. The transmission lines for coupling the feed points of the antenna elements 14*a*, 14*b*, 16*a*, 16*b*, 18*a*, 18*b*, 20*a* and 20*b* to the directivity adjusting unit 52 would be longer if the innermost end portions of the antenna elements 14*a*, 14*b*, 16*a*, 16*b*, 18*a*, 18*b*, 20*a* and 20*b* did not intersect, which would degrade the VSWR characteristic in the UHF band. Longer transmission lines would cause the respective transmission lines to be secured at locations asymmetrical with respect to each other, causing the electrical characteristics of the apparatus unstable. On the other hand, because the antenna elements 14*a*, 14*b*, 16*a*, 16*b*, 18*a*, 18*b*, 20*a* and 20*b* are disposed to intersect the associated ones as described above, the lengths of the transmission lines connecting the feed points of the respective antenna elements to the directivity adjusting unit 52 can be reduced, whereby such problems as described above can be avoided.

Figure 6:
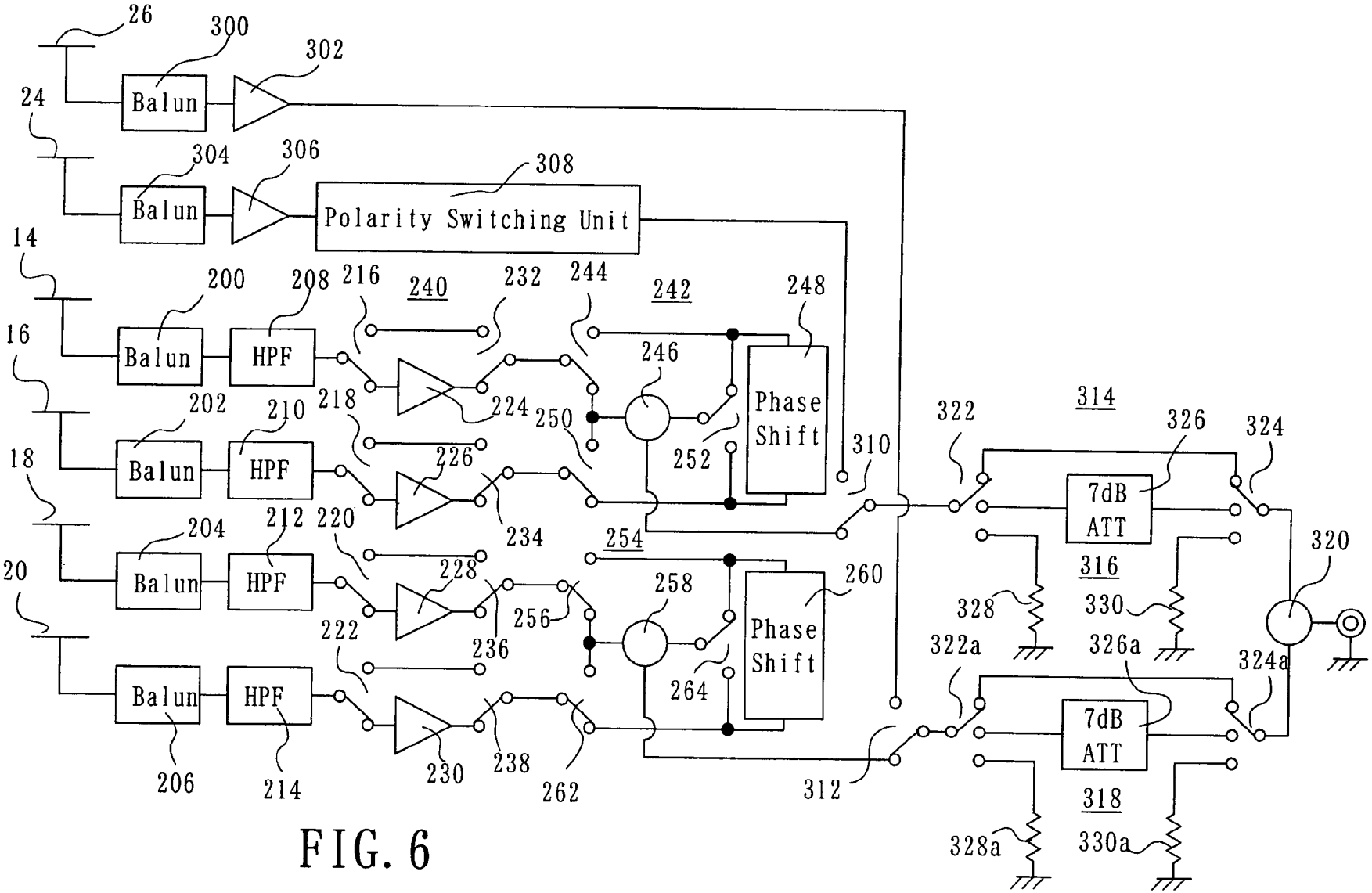
FIG. 6 is a block circuit diagram of a directivity adjusting unit of the antenna apparatus shown in FIG. 1.

For receiving the UHF television broadcast signals by the dipole antennas 14, 16, 18 and 20, the previously described electronic switches, e.g. PIN diodes, connecting together the lines and extensions of the respective dipole antennas are opened, and for receiving the VHF high television broadcast signals, the electronic switches are closed. How these electronic switches are controlled is not described in detail. Referring to FIG. 6, the reception signals from the respective dipole antennas 14, 16, 18 and 20 are coupled, via baluns 200, 202, 204 and 206 disposed on the printed circuit board arrangement of the directivity adjusting unit 52, to filter means, e.g. high-pass filters 208, 210, 212 and 214, respectively. The baluns 200 and 202 are so arranged that, when signals in phase with each other are supplied to them, they output signals in 180° out of phase. Similarly, the baluns 204 and 206 are so arranged that, when signals in phase with each other are supplied to them, they output signals in 180° out of phase. As shown in FIG. 1, the balun 200 is disposed between the antenna elements 14*a* and 14*b* of the dipole antenna 14, the balun 202 is between the antenna elements 16*a* and 16*b* of the dipole antenna 16, the balun 204 is disposed between the antenna elements 18*a* and 18*b* of the dipole antenna 18, and the balun 206 is disposed between the antenna elements 20*a* and 20*b* of the dipole antenna 20. The baluns 200, 202, 204 and 206 are disposed in the respective corners of the printed circuit board. The baluns 204 and 206 are located on the imaginary line A and in line symmetry with respect to the imaginary line A, and the baluns 200 and 202 are located on the imaginary line B and in line symmetry with respect to the imaginary line B. The high-pass filters 208, 210, 212 and 214 remove undesired frequency components from the reception signals. Output signals of the high-pass filters 208, 210, 212 and 214 are coupled to an amplification and non-amplification switching circuit 240, which is formed of changeover switches 216,218,220 and 222, amplifiers 224, 226, 228 and 230, and changeover switches 232, 234, 236 and 238, connected as shown. The amplification and non-amplification switching circuit 240 outputs amplified version or non-amplified version of the respective reception signals applied thereto via the high-pass filters. When the C/N ratios of the reception signals are small, the reception signals are amplified by the amplifiers 224, 226, 228 and 230, respectively.

The signals as outputted from the amplification and non-amplification switching circuit 240, corresponding to the reception signals from the dipole antennas 14 and 16, are applied to a phase adjusting and combining circuit 242. In the phase adjusting and combining circuit 242, the signal corresponding to the reception signal from the dipole antenna 14 as applied from the amplification and non-amplification switching circuit 240 is coupled, via a changeover switch 244, either to a first input terminal of a combining circuit 246 or to a first end of a phase shift circuit 248. Similarly, the signal corresponding to the reception signal from the dipole antenna 16 as applied from the amplification and non-amplification switching circuit 240 is coupled, via a changeover switch 250, either to the first input terminal of the combining circuit 246 or to a second end of the phase shift circuit 248. A second input terminal of the combining circuit 246 receives, via a changeover switch 252, the signal at the first or second end of the phase shift circuit 248. The changeover switches 244, 250 and 252 are operated together in such a manner that, when the changeover switch 244 couples the signal corresponding to the reception signal from the antenna 14 to the first input terminal of the combining circuit 246, the changeover switch 250 couples the signal corresponding to the reception signal from the dipole antenna 16 to the second end of the phase shift circuit 248, and the changeover switch 252 couples the signal at the first end of the phase shift circuit 248 to the second input terminal of the combining circuit 246. Conversely, when the changeover switch 250 couples the signal corresponding to the reception signal from the antenna 16 to the first input terminal of the combining circuit 246, the changeover switch 244 couples the signal corresponding to the reception signal from the dipole antenna 14 to the first end of the phase shift circuit 248, and the changeover switch 252 couples the signal at the second end of the phase shift circuit 248 to the second input terminal of the combining circuit 246. The amount of phase shift provided by the phase shift circuit 248 will be discussed later.

Similarly, the signals as outputted from the amplification and non-amplification switching circuit 240, corresponding to the reception signals from the dipole antennas 18 and 20, are applied to a phase adjusting and combining circuit 254. In the phase adjusting and combining circuit 254, the signal corresponding to the reception signal from the dipole antenna 18 as applied from the amplification and non-amplification switching circuit 240 is coupled, via a changeover switch 256, either to a first input terminal of a combining circuit 258 or to a first end of a phase shift circuit 260. Similarly, the signal corresponding to the reception signal from the dipole antenna 20 as applied from the amplification and non-amplification switching circuit 240 is coupled, via a changeover switch 262, either to the first input terminal of the combining circuit 258 or to a second end of the phase shift circuit 260. A second input terminal of the combining circuit 258 receives, via a changeover switch 264, the signal at the first or second end of the phase shift circuit 260. The changeover switches 256, 262 and 264 are operated together in such a manner that, when the changeover switch 256 couples the signal corresponding to the reception signal from the antenna 18 to the first input terminal of the combining circuit 258, the changeover switch 262 couples the signal corresponding to the reception signal from the dipole antenna 20 to the second end of the phase shift circuit 260, and the changeover switch 264 couples the signal at the first end of the phase shift circuit 260 to the second input terminal of the combining circuit 258. Conversely, when the changeover switch 262 couples the signal corresponding to the reception signal from the antenna 20 to the first input terminal of the combining circuit 258, the changeover switch 256 couples the signal corresponding to the reception signal from the dipole antenna 18 to the first end of the phase shift circuit 260, and the changeover switch 264 couples the signal at the second end of the phase shift circuit 260 to the second input terminal of the combining circuit 258. The amount of phase shift provided by the phase shift circuit 260 will be described later.

By the use of the phase adjusting and combining circuit 242 described above, the combined directivity of the dipole antennas 14 and 16 can be selectively oriented to a direction outward direction from the intersection of the imaginary lines A, B, C and D along the antenna element 26*a* (FIG. 1), which direction is referred to as the forward direction hereinafter, and to a direction outward from the imaginary line intersection along the antenna element 26*b*, which direction is referred to as the backward direction. Similarly, the use of the phase adjusting and combining circuit 254 makes it possible to selectively orient the combined directivity of the dipole antennas 18 and 20 to a direction outward from the imaginary line intersection along the antenna element 24*b*, which direction is referred to as the rightward direction hereinafter, and to a direction outward from the imaginary line intersection along the antenna element 24*a*, which direction is referred to as the leftward direction hereinafter.

Both the dipole antennas 14 and 16 have an 8-shaped directivity. Let it be assumed that a radio wave comes toward the dipole antennas 14 and 16 from the back of the antenna apparatus. A UHF band wave coming from the back is received by the dipole antennas 14 and 16, and outputs are developed at the baluns 200 and 202. The output from the balun 202 corresponding to the reception signal from the forward antenna 16 is delayed by an amount D corresponding to the distance (smaller than a quarter of $\lambda$) between the dipole antennas 14 and 16, relative to the output from the balun 200 corresponding to the reception signal from the backward antenna 14. The baluns 200 and 202 are so arranged that the phase of the output from the balun 202 is 180°-out-of-phase with the output signal from the balun 200. In other words, the output signal of the balun 202 has a phase difference of $-\lambda/2-D$ from the output signal of the balun 200. Then, the changeover switches 244, 250 and 252 are controlled in such a manner that the output signal of the balun 202 can be applied as it is to the combining circuit 246, whereas the output signal of the balun 200 can be given a predetermined amount of delay of D1 in the fixed phase shift circuit 248 to thereby have a phase difference of −D1 relative to the output signal of the balun 202, before it is applied to the combing circuit 246. The amount of delay, D1, is so determined that the difference between −D1 and $(-\lambda/2-D)$ can be about $\lambda/2$. In other words, the delay D1 is set to D. Accordingly, the signals corresponding to the reception signals from the dipole antennas 14 and 16 at the first and second inputs of the combining circuit 246 are substantially 180°-out-of-phase, which means that the dipole antennas 14 and 16 in combination do not exhibit a backward directivity, but the combined directivity of the dipole antennas 14 and 16 is oriented to the forward direction.

Conversely, when a UHF band radio wave coming from the forward direction is received by the dipole antennas 14 and 16, the output signal of the balun 200 corresponding to the reception signal from the dipole antenna 14 is delayed by the amount D relative to the reception signal from the dipole antenna 16. By virtue of the different arrangements of the baluns 200 and 202, the output signal of the balun 202 is 180°-out-of-phase with the reception signal from the dipole antenna 14. Then, the output signal of the balun 202 has a phase difference equal to $-\lambda/2$ from the reception signal of the dipole antenna 14, and the output signal of the balun 200 has a phase difference equal to −D from the reception signal from the dipole antenna 16.

Now, let it be assumed that the changeover switches 244, 250 and 252 are switched to the positions in which the output signal of the balun 202 is applied to the phase shift circuit 248, the output of the phase shift circuit 248 is applied to the second input terminal of the combining circuit 246 and the output signal of the balun 200 is applied to the first input terminal of the combining circuit 246. Then, the output of the balun 202 is delayed by the phase shift circuit 248 before it is applied to the combining circuit 246, whereas the output signal of the balun 200 is applied to the combining circuit 246, as it is. Because the output signal of the balun 202 is delayed by an amount of D by the phase shift circuit 248, the output signal of the balun 202 at the input of the combining circuit 246 has a phase of $-\lambda/2-D$, so that it's phase difference from the output of the balun 200 is $-\lambda/2$. This causes the combined directivity of the dipole antennas 14 and 16 to be oriented to the backward direction.

As described above, the phase adjusting and combining circuit 242 uses the same phase shift circuit 248 for providing either forward or backward oriented directivity.

The reception signals from the dipole antennas 18 and 20 are processed in the phase adjusting and combining circuit 254 in the same manner as the reception signals from the antennas 14 and 16 described above, so that the combined directivity of the antennas 18 and 20 can be selectively oriented to the rightward and leftward directions. The amount of delay to be provided by the phase shift circuit 260 is equal to the one provided by the phase shift circuit 258.

As shown in FIG. 6, the reception signal from the dipole antenna 26 is coupled through a balun 300 to an amplifier 302, where it is amplified. The reception signal from the dipole antenna 24 is coupled through a balun 304 to an amplifier 306, where it is amplified. The amplified reception signal from the antenna 24 is applied to a polarity switching unit 308, which outputs the output signal of the amplifier 306 with the same polarity as it is applied thereto or with the reversed polarity.

A changeover switch 310 selects either of the output signals of the combining circuit 246 and the polarity switching unit 308. A changeover switch 312 selects either of the output signals of the combining circuit 258 and the amplifier 302. The changeover switches 310 and 312 are controlled in such a manner as to select either the output signals of both combining circuits 246 and 258 together, or the output signals of the polarity switching unit 308 and the amplifier 302 together.

The two signals selected by the changeover switches 310 and 312 are applied to a level adjusting circuit 314. By appropriately selecting the directivity of the UHF or VHF high band signal from the combining circuit 246 and the directivity of the UHF or VHF high band signal from the combining circuit 258 applied to the level adjusting circuit 314, and appropriately adjusting the levels of the signals in the level adjusting circuit 314 and combining them, the directivity of the combined signal can be oriented to any desired direction at an angle relative to zero (0) degree, which corresponds to, for example, the forward direction. Similarly, if the signals applied to the level adjusting circuit 314 are the VHF low band signals, exhibiting an 8-shaped directivity, from the amplifier 302 and the polarity switching unit 308, a combined signal having an 8-shaped directivity oriented to any desired direction at an angle relative to the forward direction can be obtained by appropriately selecting the polarities of the signals and appropriately adjusting the levels of the signals in the level adjusting circuit 314.

For that purpose, the level adjusting circuit 314 includes level adjusting means, e.g. variable attenuators 316 and 318, and a combiner 320 for combining output signals of the variable attenuators 316 and 318. Each of the variable attenuators 316 and 318 is arranged to selectively provide an amount of attenuation in multiple steps, e.g. three steps, namely, 0 dB, 7 dB and infinity (∞). The resultant signal can have a directivity oriented to any desired numbers of directions, e.g. sixteen (16) directions at angular intervals of 22.5 degrees, relative to the forward direction at zero (0) degree. This is achieved by adjusting the directivities and adjusting the amounts of attenuation provided by the variable attenuators 316 and 318, for a UHF or VHF high band signal, or by adjusting the polarities and adjusting the amounts of attenuation provided by the variable attenuators 316 and 318, for a VHF low band signal.

The variable attenuator 316 includes an input-side changeover switch 322 connected to the changeover switch 310, and an output-side changeover switch 324 connected to the combiner 320. The switches 322 and 324 are operated together. When the changeover switches 322 and 324 are placed in their first position, the signal as selected by the changeover switch 310 is coupled, as it is, to the combiner 320 via the switch 324. In other words, the amount of attenuation given to the signal is zero (0). With the changeover switches 322 and 324 in their second position, the signal selected by the switch 310 is attenuated by an attenuating circuit 326 providing an amount of attenuation of 7 dB and, thereafter, applied to the combiner 320. In other words, the amount of attenuation of the variable attenuator 316 is 7 dB. When the switches 322 and 324 are placed in their third position, they are grounded through matching resistors 328 and 330, respectively, having an impedance value equal to the impedance of the respective dipole antennas. Accordingly, the output signal from the changeover switch 310 is not coupled to the combiner 320. That is, the amount of attenuation is infinite.

The variable attenuator 318 is arranged similar to the variable attenuator 316, and, therefore, no detailed description about it is given. It should be noted that the same reference numerals as used for the components of the variable attenuator 316 are attached to similar components, with a suffix "a" added to the ends of the respective reference numerals.

Whichever UHF, VHF high or VHF low band signal is to be received, the amount of attenuation given by the variable attenuator 316 is zero (0) for the directivities at zero (0) degree, 22.5 degrees and 45 degrees, but it is 7 dB and infinity for the directivities of 67.5 degrees and 90 degrees, respectively. The amount of attenuation for the directivities oriented to the directions at 112.5 degrees and 135 degrees is 7 dB, and it is maintained at zero (0) for the directivities of 157.5 degrees, 180 degrees, 202.5 degrees and 225 degrees. The amount of attenuation for the directivities oriented to the directions of 247.5 degrees and 270 degrees is 7 dB and infinity, respectively, and the amount of attenuation for the directivities oriented to the directions of 292.5 degrees and 315 degrees is 7 dB and zero (0), respectively. The amount of attenuation is maintained at zero (0) for the directivity of 337.5 degrees.

The amount of attenuation in the variable attenuator 318 is infinity, 7 dB and zero (0) for the directivities of zero (0) degree, 22.25 degrees and 45 degrees, respectively. It is maintained at zero (0) for the directivities of 67.5 degrees, 90 degrees, 112.5 degrees and 135 degrees. For the azimuth angels of 157.5 degrees and 180 degrees, the amount of attenuation is 7 dB and infinity, respectively, and it is 7 dB and zero (0) for the azimuth angles of 202.5 degrees and 225 degrees. For the directivities for the azimuth angles of 247.5 degrees, 270 degrees, 293.5 degrees and 315 degrees, the amount of attenuation is maintained to be zero (0), and it is 7 dB for the directivity for the azimuth angle of 337.5 degrees. Like this, when the amount of attenuation of one variable attenuator is zero (0), that of the other variable attenuator increases or decreases.

Figure 7:
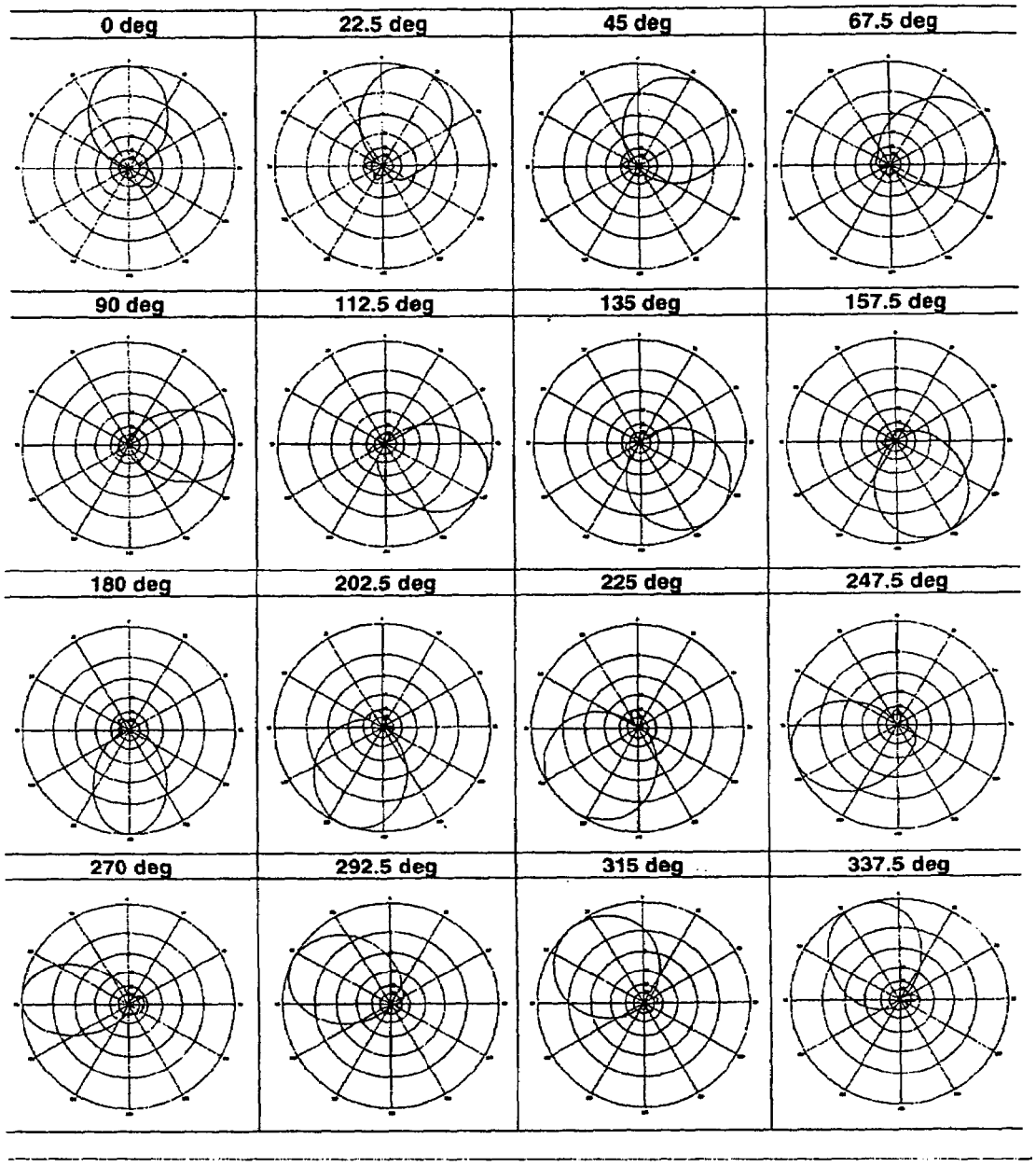
FIG. 7 illustrates how the directivity of the antenna apparatus of FIG. 1 at a frequency of 545 MHz can vary.
Figure 8:
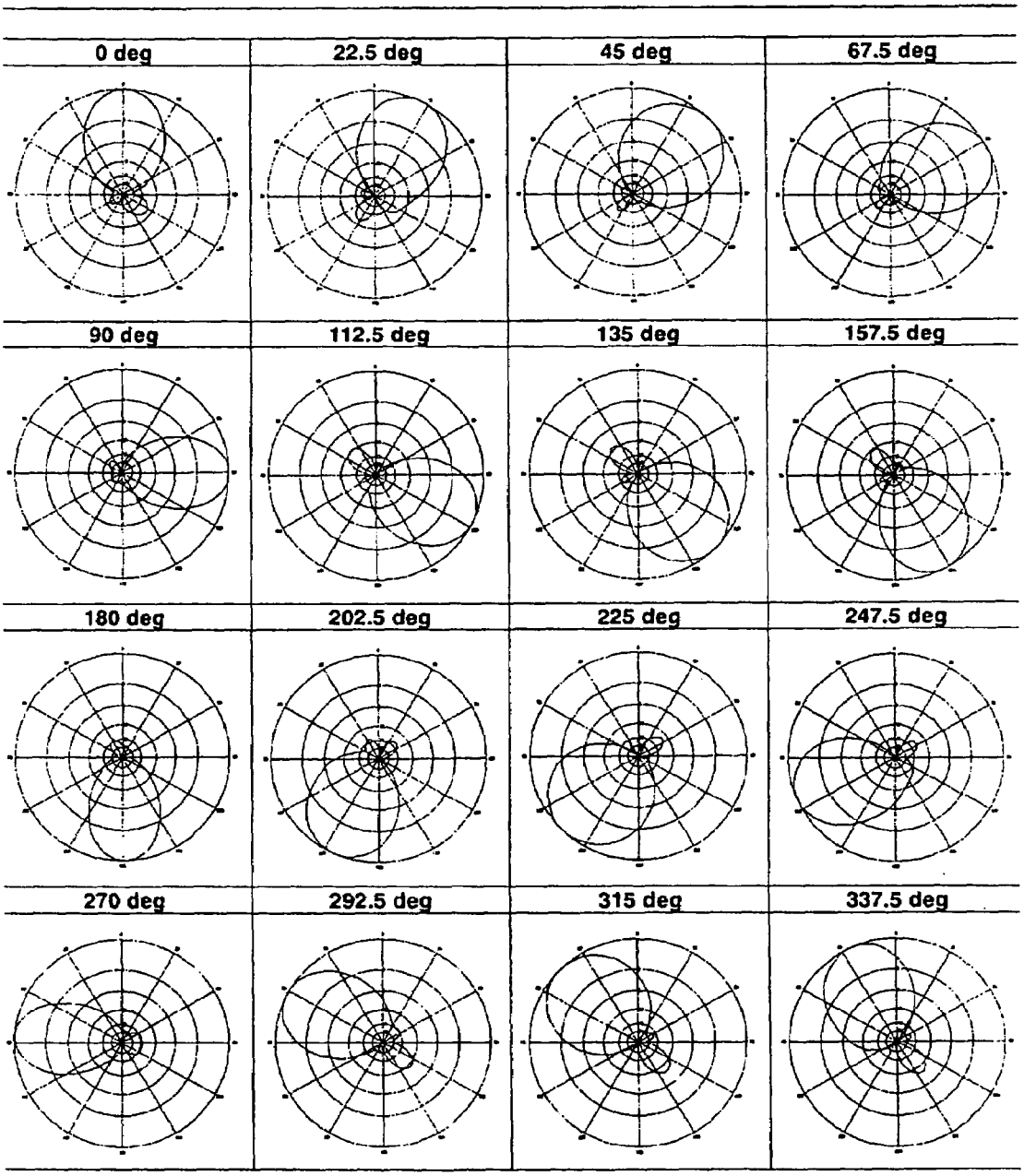
FIG. 8 illustrates how the directivity of the antenna apparatus of FIG. 1 at a frequency of 581 MHz can vary.

FIGS. 7 and 8 show directivities thus obtained. FIG. 7 shows the directivity oriented to various directions at a frequency of 545 MHz, and FIG. 8 shows similar directivity at a frequency of 581 MHz. It is seen from FIGS. 7 and 8 that there are no substantial distortions in the directivity pattern in any directions. This is by virtue of the described arrangement in which the dipole antennas 14, 16, 18 and 20 are disposed in line symmetry with respect to the imaginary lines A, B, C and D, and the baluns 200, 202, 204 and 206 are disposed in line symmetry with respect to the imaginary lines A and B. With this arrangement, the lengths of the lines for connecting the feed points of the dipole antennas 14, 16, 18 and 20 to the corresponding baluns 200, 202, 204 and 206 can be substantially equal to each other, so that no differences in phase are introduced for the antennas 14, 16, 18 and 20, which would otherwise be caused if the lengths of such connecting lines were different.

As shown in FIGS. 1 and 4, a second support, e.g. a partition 54, is formed within the main body 2 to be integral with the bottom wall 2*a* in such a manner as to surround the directivity adjusting unit 52. Viewed in plan, the partition 54 extends in a generally octagonal shape similar to the shape of the peripheral wall 2*b*. The height of the partition 54 is substantially the same as that of the peripheral wall 2*b*. A plurality of reinforcing members 56 for reinforcing the partition 54 are formed at intervals on the inner side of the partition 54. Eight (8) slits 108 are formed in the partition 54, which extend from the upper edge down to an intermediate point of the partition 54. Intermediate portions of the antenna elements 14*a*, 14*b*, 16*a*, 16*b*, 18*a*, 18*b*, 20*a* and 20*b* are placed into the associated slits 108. The depth of the slits 108 is such that the upper edges of the antenna elements 14*a*, 14*b*, 16*a*, 16*b*, 18*a*, 18*b*, 20*a* and 20*b* placed in the slits 108 can be positioned horizontal, and the width of the slits 108 is slightly larger than the thickness of the antenna elements 14*a*, 14*b*, 16*a*, 16*b*, 18*a*, 18*b*, 20*a* and 20*b*. The partition 54 contacts the first elements 24*a*, 24*b*, 26*a* and 26*b* of the dipole antennas 24 and 26 at their intermediate portions, and, therefore, acts as a support for the antenna elements 24*a*, 24*b*, 26*a* and 26*b*. At locations outside and inside the partition 54, a plurality of drainage holes 58 are formed to extend through the bottom walls 2*a*.

As shown in FIG. 3, a partition 60 similar to the partition 54 is formed integrally with the top wall 4*a* in the lid 4 in such a location that it can be positioned outward of the partition 54 when the lid 4 is placed to close the opening in the lower half of the main body 2. The partition 60 is formed such that its distal edge can contact the antenna elements, 14*a*, 14*b*, 16*a*, 16*b*, 18*a*, 18*b*, 20*a* and 20*b* and the first antenna elements 24*a*, 24*b*, 26*a* and 26*b*, when the lid 4 is placed to close the opening in the lower half of the main body 2. Accordingly, when the lid 4 closes the opening of the main body 2, the antenna elements 14*a*, 14*b*, 16*a*, 16*b*, 18*a*, 18*b*, 20*a* and 20*b* and the first antenna elements 24*a*, 24*b*, 26*a* and 26*b* are placed between and secured by the lower and upper partitions 54 and 60.

As shown in FIG. 3, first pressing members 110 are formed integral with the lid 4 at locations on the inner surface of the lid 4 corresponding to the bosses 22 on the bottom wall 2*a*. These first pressing members 110 are formed in a ring shape, as shown, and press down the upper edges of the antenna elements 14*a*, 14*b*, 16*a*, 16*b*, 18*a*, 18*b*, 20*a* and 20*b* at the respective bosses 22 when the lid 4 is placed to close the opening in the main body 2. In this manner, the lid 4 functions not only to close the opening in the main body 2 but also to secure the antenna elements 14*a*, 14*b*, 16*a*, 16*b*, 18*a*, 18*b*, 20*a* and 20*b* in place by pressing them against the bosses 22.

As shown in FIGS. 3 and 5, second pressing members 112, eight in total, are formed on the inner surface of the lid 4 to be integral therewith at locations corresponding to the eight slits 108 in the partition 54. When the lid 4 is placed to close the opening in the main body 2, the second pressing members 112 are located inward of the partition 54 and extend downward from the inner surface of the lid 4 to points by the respective slits 108. The second pressing members 112 are tapered, and the portions slightly above the respective tapered tip ends contact and press the antenna elements 14*a*, 14*b*, 16*a*, 16*b*, 18*a*, 18*b*, 20*a* and 20*b* against one edge, e.g. an outer edge, of the respective slits 108 when the lid 4 is placed to cover the opening in the main body 2. When the lid 4 is placed to close the opening in the main body 2, the second pressing members 112 prevent the antenna elements 14*a*, 14*b*, 16*a*, 16*b*, 18*a*, 18*b*, 20*a* and 20*b* from moving in the slits 108.

In the above-described embodiment, the antenna elements 14*a*, 14*b*, 16*a*, 16*b*, 18*a*, 18*b*, 20*a* and 20*b* of the UHF band dipole antennas 14, 16, 18 and 20 are formed separate. However, four printed circuit boards may be prepared for the respective antennas 14, 16, 18 and 20, each including two spaced-apart antenna elements lying in line to forms the dipole antenna 14, 16, 18 or 20. In such a case, the dipole antenna 14 is arranged to intersect the dipole antennas 18 and 20 at two intermediate points thereof, the dipole antenna 16 is arranged to intersect the dipole antennas 18 and 20 at two intermediate points thereof, and the first supports 22 are formed at the respective intersections.

In the above-described embodiment, the first pressing members 110 are formed to press down the antenna elements 14*a*, 14*b*, 16*a*, 16*b*, 18*a*, 18*b*, 20*a* and 20*b* against the first supports or bosses 22 at the intersections of the antenna elements, but the first pressing members 110 may be arranged to press down the upper edges of the respective antenna elements against the first supports 22 at locations other than the intersection of the antenna elements. In such case, the upper edges of the antenna elements 14*a*, 14*b*, 16*a*, 16*b*, 18*a*, 18*b*, 20*a* and 20*b* may be at a level slightly nearer to the bottom wall 2*a* than the top portions of the first supports 22.

The antenna apparatus according to the above-described embodiment includes both UHF band and VHF band dipole antennas, but it may include only dipole antennas for the UHF band. Further, according to the described embodiment, the partitions 56 and 60 are used, but the partition 60 may be omitted. Also, in place of the continuous partition 56, separate supports having the slits 108 may be formed at only those locations in the vicinity of intermediate portions of the antenna elements 14*a*, 14*b*, 16*a*, 16*b*, 18*a*, 18*b*, 20*a* and 20*b*.

What is claimed is:

1. An antenna apparatus comprising: a casing and first, second, third and fourth dipole antennas for receiving radio waves in a same frequency band;

wherein:

said first through fourth dipole antennas are positioned in a same plane;

said first and second dipole antennas are located on opposite sides of a first imaginary line passing through said casing, feed points of said first and second dipole antennas being located on opposite sides of an intersection of said first imaginary line and a second imaginary line orthogonal to said first imaginary line;

said third and fourth dipole antennas are located on opposite sides of said second imaginary line, feed points of said third and fourth dipole antennas being located on opposite sides of said intersection of said first and said second imaginary lines;

said first and second dipole antennas are disposed in line symmetry with said second imaginary line being an axis of symmetry, said third and fourth dipole antennas are disposed in line symmetry with said first imaginary line being an axis of symmetry, and said first through fourth dipole antennas are in line symmetry with third and fourth imaginary lines being axes of symmetry, said third and fourth imaginary lines passing through said intersection of said first and second imaginary lines at 45 degrees with respect to said first and second imaginary lines; and a directivity adjusting means is disposed in said casing, said directivity adjusting means adjusting the phases and levels of reception signals from said first through fourth dipole antennas thereby to provide a combined directivity of said first through fourth dipole antennas oriented to a desired direction.

2. The antenna apparatus according to claim 1 wherein said directivity adjusting means including first phase adjusting means adjusting the phases of reception signals from said first and second dipole antennas and combining the phase adjusted reception signals to thereby provide a combined directivity of said first and second dipole antennas oriented either to a first direction or an opposite second direction, second phase adjusting means adjusting the phases of reception signals from said third and fourth dipole antennas and combining the phase adjusted reception signals to thereby provide a combined directivity of said third and fourth dipole antennas oriented either to a third direction and an opposite fourth direction, level adjusting and combining means adjusting levels of output signals of said first and second phase adjusting means and combining the level adjusted signals.

3. The antenna apparatus according to claim 1 wherein said first through fourth dipole antennas each comprising first and second antenna elements having their innermost portions located outward of said intersections of said first and second imaginary lines.

4. The antenna apparatus according to claim 1 wherein the innermost portions of said antenna elements of said first dipole antenna are disposed to intersect the innermost portion of one of said antenna elements of said third dipole antenna on one side of said antenna apparatus and the innermost portion of one of said antenna elements of said fourth dipole antenna located on said one side of said antenna apparatus, respectively; the innermost portions of said antenna elements of said second dipole antenna are disposed to intersect the innermost portion of the other of said antenna elements of said third dipole antenna on the other side of said antenna apparatus and the innermost portion of the other of said antenna elements of said fourth dipole antenna on said other side of said antenna apparatus, respectively; and the intersections of said innermost portions of said antenna elements are on said third and fourth imaginary lines.

5. The antenna apparatus according to claim 4 wherein a square substrate on which said directivity adjusting means is disposed is positioned in said casing with a center of said square substrate positioned at a location in the vicinity of said intersection of said first and second imaginary lines, and with diagonals thereof extending in line with said first and second imaginary lines; said rectangular substrate having its corners cut away.

* * * * *